US012305338B1

(12) United States Patent
Bigger et al.

(10) Patent No.: US 12,305,338 B1
(45) Date of Patent: May 20, 2025

(54) ONE-PIECE RAIL BOOT WITH INTEGRATED FLANGEWAY FORMER

(71) Applicant: Polycorp Ltd., Elora (CA)

(72) Inventors: Matthew Thomas Bigger, Elora (CA); Marco Leone, Elora (CA)

(73) Assignee: Polycorp Ltd., Elora (CA)

( * ) Notice: Subject to any disclaimer, the term of this patent is extended or adjusted under 35 U.S.C. 154(b) by 817 days.

(21) Appl. No.: 17/526,041

(22) Filed: Nov. 15, 2021

(51) Int. Cl.
*E01B 13/02* (2006.01)
*E01B 27/02* (2006.01)

(52) U.S. Cl.
CPC ..... *E01B 13/02* (2013.01); *E01B 27/022* (2013.01)

(58) Field of Classification Search
CPC ..... E01B 1/002; E01B 1/004; E01B 13/02; E01B 15/00; E01B 27/022
See application file for complete search history.

(56) References Cited

U.S. PATENT DOCUMENTS 8,172,158 B1 * 5/2012 Burkhardt ..... E01B 19/003 238/2
9,617,688 B2 4/2017 Ellis
10,370,798 B2 8/2019 Ellis

* cited by examiner

*Primary Examiner* — Robert J McCarry, Jr.

(57) ABSTRACT

A rail boot for encasing preselected engagement portions of a rail, including a base segment, for encasing a rail foot of the rail, and field and gauge side segments connected with the base segment. The field and gauge side segments are for encasing the field and gauge sides of a rail web of the rail respectively. Also, the field side segment is formed for encasing a first preselected portion of the field side of a rail head of the rail. The gauge side segment is formed for encasing a second preselected portion of the gauge side of the rail head. The rail boot also include an outer segment extending outwardly from the gauge side segment and defining a bottom side and an outer side of a flangeway, in which flanges of rail wheels rolling along the rail are receivable.

12 Claims, 10 Drawing Sheets

ONE-PIECE RAIL BOOT WITH INTEGRATED FLANGEWAY FORMER

FIELD OF THE INVENTION

The present invention is a one-piece rail boot with an integrated flangeway former.

BACKGROUND OF THE INVENTION

In the prior art, rail boots may be provided in two separate pieces, which are assembled together installation. A typical prior art rail boot 10 assembly is illustrated in FIGS. 1A and 1B. The prior art rail boot 10 assembly includes a body 12 that is formed to fit around a rail 14, and a flangeway former 16 that is intended to engage with the body 12.

The prior art rail boot assembly 10 is shown installed in FIG. 1B, with fill material 17 in place on each side of the boot 10. The fill material may be one or more materials, for example, concrete and/or asphalt and/or polymeric grout. As can be seen in FIGS. 1A and 1B, in order for a flangeway 20 to be formed in which a flange (not shown) on a rail wheel located on the rail is receivable, the flangeway former 16 is required to be located in a predetermined position relative to the body 12. In FIG. 1A, the prior art rail boot 10 is illustrated when the boot assembly 10 is in position with the body 12 on the rail 14, and with the flangeway former 16 in the predetermined position thereof, but prior to fill material (e.g., concrete) being installed.

As can be seen in FIGS. 1A-1C, the rail 14 has a rail head 30 with a top surface 32, and a rail foot 34 connected by a rail web 36. Each of the rail head 30 and the rail web 36 has respective opposed field sides "$F_H$", "$F_W$", and respective opposed gauge sides "$G_H$", "$G_W$". As is well known in the art, the rail 14 is formed to support rail wheels "A" that are engaged with the top surface 32. Each rail wheel "A" includes a flange "B" that extends below the top surface 32 on the gauge side "$G_H$" of the rail head 30 (FIG. 2E), when the rail wheel "A" rolls along the top surface 32.

As can be seen in FIGS. 1A-1C, one side portion $\mathbf{12}_F$ of the body 12 engages the field side of the rail head and the rail web "$F_H$", "$F_W$", and the other side portion $\mathbf{12}_G$ of the body 12 engages the gauge side of the rail head and the rail web "$G_H$", "$G_W$".

Typically, the body 12 and the flangeway former 16 are provided in lengths of approximately eight feet (approximately 2.44 meters). The rail 14 may be provided, for example, in lengths of approximately 120 feet (approximately 36.6 meters). In the prior art, each body 12 and flangeway former 16 are required to be joined at their respective ends with the abutting bodies 12 and flangeway formers 16, using techniques intended to provide continuous isolation of the rail 14 along its length. However, the joints formed to join the lengths of the body 12 and the flangeway former 16 to the next lengths thereof tend to provide points at which the rail 14 may be exposed to stray currents. Because the lengths of the body 12 and the flangeway former 16 that are typically provided are relatively short, a relatively large number of joints are required, with a commensurately increased risk of potential exposure to stray currents.

The body 12 of the prior art rail boot assembly 10 is intended to dampen vibration that may be imparted to the rail by wheels of rail vehicles (not shown) that are supported by the rail as the wheels pass along the rail. The rail boot body 12 is also intended to minimize the risk of a stray electrical current in the ground being transmitted to the rail 14, which may then cause various electrical faults for the railway system, e.g., if stray currents are if transmitted along the rail 14. However, in practice, the prior art rail boot assembly 10 sometimes fails to achieve these objectives.

The flangeway former 16 is shaped to cooperate with the gauge side portion $\mathbf{12}_G$ of the body 12, as illustrated in FIGS. 1A and 1B. As can be seen in FIG. 1A, when the flangeway former 16 is in its predetermined position, the flangeway former's inner side "H" fits with an outer side "J" of the gauge side portion $\mathbf{12}_G$ (FIG. 1A). However, even if the flangeway former 16 is in its predetermined position, as shown in FIG. 1A, water can get into a gap "Q" between the body 12 and the flangeway former 16. Due to the water in the gap "Q" repeatedly freezing and then thawing, the flangeway former 16 may be pushed out of the predetermined position, and damage may result to the fill material (e.g., concrete) also, as well as corrosion of the rail.

The gap "Q" may cause other problems. As an example, a path "P" for stray currents is identified in FIG. 1A (schematically represented by arrows "$P_1$", "$P_2$", "$P_3$"), in the gap "Q" that is formed between the body 12 and the flangeway former 16.

The width of the gap "Q" may vary in practice due to poor manufacturing processes of the flangeway former 16 and/or the body 12, or due to improper installation of the flangeway former 16 and the body 12. Improper positioning of the flangeway former 16 can result in various operational issues.

Because the flangeway former 16 is provided separately from the body 12, the flangeway former 16 is required to be supported by one or more supports, to hold the flangeway former 16 in its predetermined position relative to the body 12 while the fill material 17 (e.g., concrete) is installed, and after the fill 17 has been installed. For example, as can be seen in FIG. 1A, the prior art rail boot 10 may include a lower clip 22 that secures a lower portion 23 of the body 12 in place, and the lower clip 22 may include a support arm 24 that holds a lower end 26 of the flangeway former 16 in place. However, positioning these hardware elements can be time-consuming, and may not be done properly, especially where conditions are not ideal.

In the prior art, it is also typical that the rail boot assembly 10 includes one or more upper clips 27, to hold an upper end 28 of the flangeway former 16 in place (i.e., so that the flangeway former 16 remains in its predetermined position) during the installation of the fill material(s). The upper clips 27 are removed after the installation of the fill material 17 has been completed, for example, if concrete is used, the upper clips 27 are removed after the concrete has cured.

In summary, the prior art rail boot assembly 10 has a number of disadvantages and deficiencies. First, because the flangeway former 16 is physically separate from the body 12, and positioned next to the body 12 after the rail 14 and the body 12 are located in their intended positions, the flangeway former 16 defines a gap between it and the body. This provides a path for stray currents, and also an opportunity for water to be held in the assembly.

The prior art rail boot 10 may not be properly installed, because the flangeway former 16 must be located in the predetermined position thereof, and then held in place by hardware elements before the fill material is introduced. The flangeway former 16 may not be located in its predetermined position as a result, once the fill material is installed. If the flangeway former 16 is not in its predetermined position, then the rail boot assembly 10 may not achieve its purposes.

Also, the prior art body 12 and flangeway former 16 are typically provided in relatively short lengths, resulting in a relatively large number of joints along the rail 14 required during installation.

SUMMARY OF THE INVENTION

For the foregoing reasons, there is a need for a rail boot that overcomes or mitigates one or more of the defects and disadvantages of the prior art.

In its broad aspect, the invention provides a rail boot for encasing preselected engagement portions of a rail. The rail boot includes a base segment, for encasing a rail foot of the rail, and field and gauge side segments connected with the base segment. The field and gauge side segments are for encasing the field and gauge sides of a rail web of the rail respectively. The field side segment is also formed for encasing a first preselected portion of the field side of a rail head of the rail. The gauge side segment is formed to encasing a second preselected portion of the gauge side of the rail head. The rail boot also includes an outer segment extending outwardly from the gauge side segment and defining a bottom side and an outer side of a flangeway, in which flanges of rail wheels rolling along the rail are receivable.

BRIEF DESCRIPTION OF THE DRAWINGS

The invention will be better understood with reference to the attached drawings, in which.

DETAILED DESCRIPTION

Figure 1A:
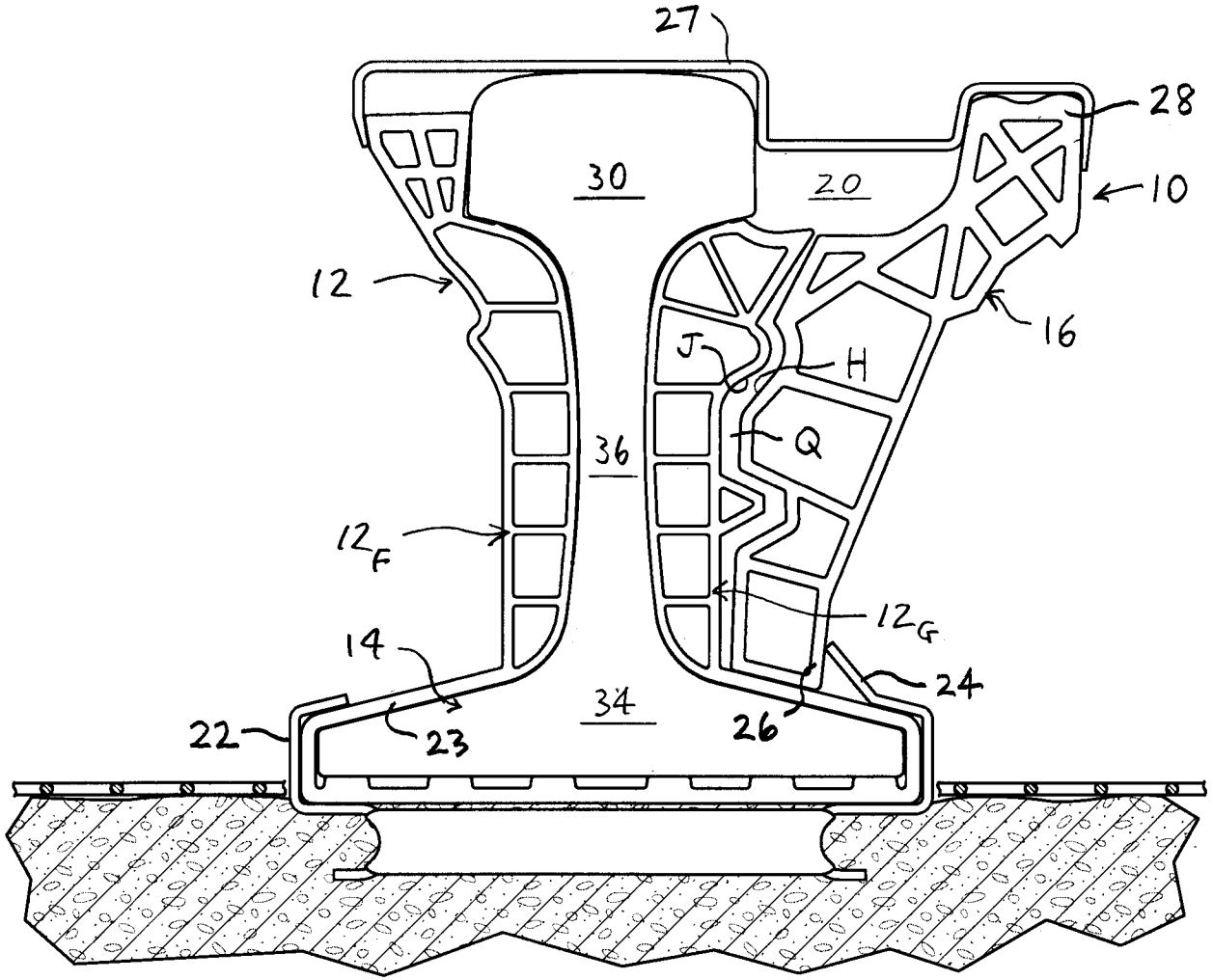
FIG. 1A (PRIOR ART)
FIG. 1A (previously described) is an end view of a rail and a rail boot assembly of the prior art, partly installed.
Figure 1B:
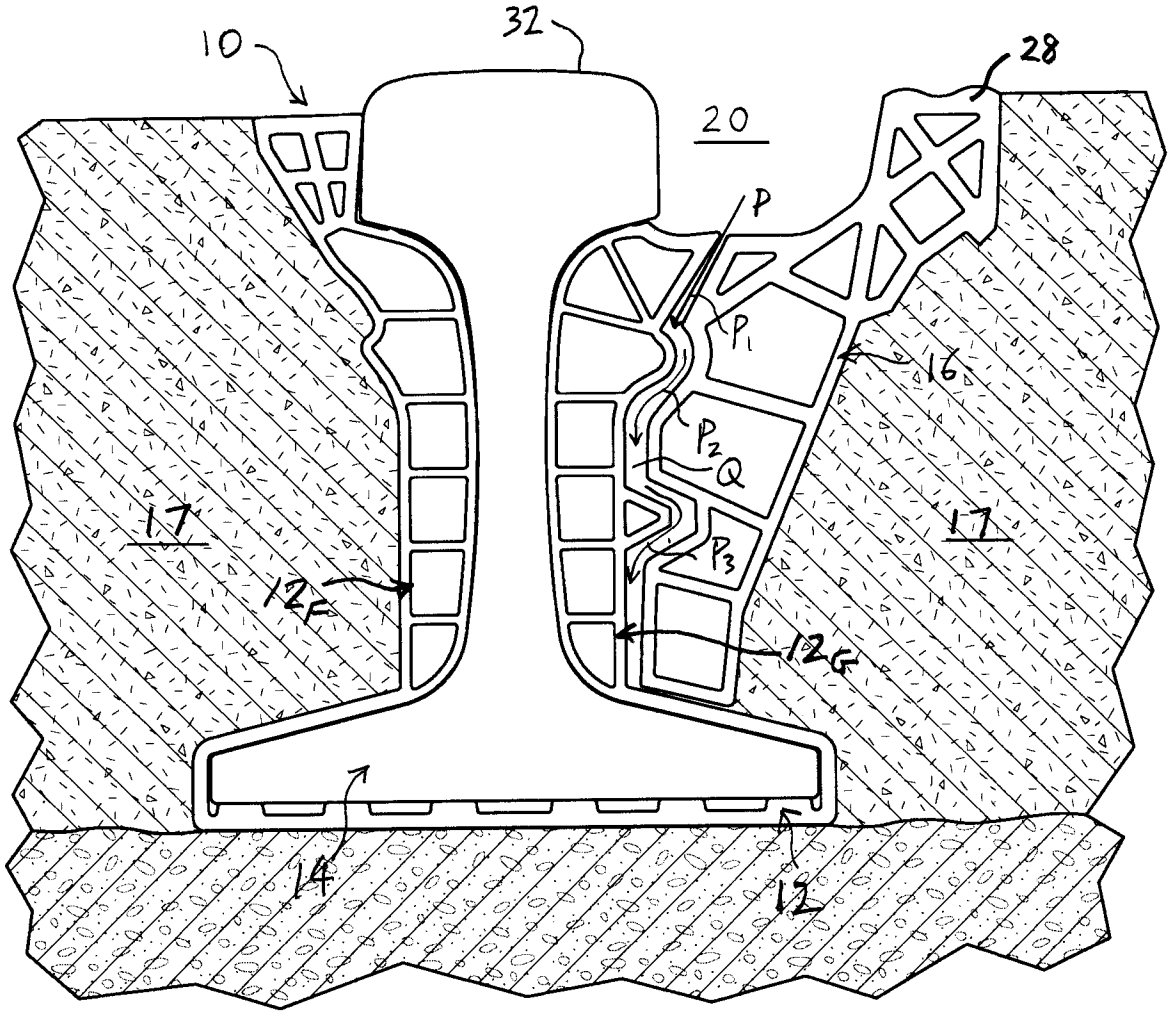
FIG. 1B (PRIOR ART)
FIG. 1B (previously described) is an end view of the rail and the rail boot assembly of FIG. 1A, fully installed.

In the attached drawings, like reference numerals designate corresponding elements throughout. Reference is first made to FIGS. 2A-3A to describe an embodiment of a rail boot in accordance with the invention indicated generally by the numeral 40.

Figure 2A:
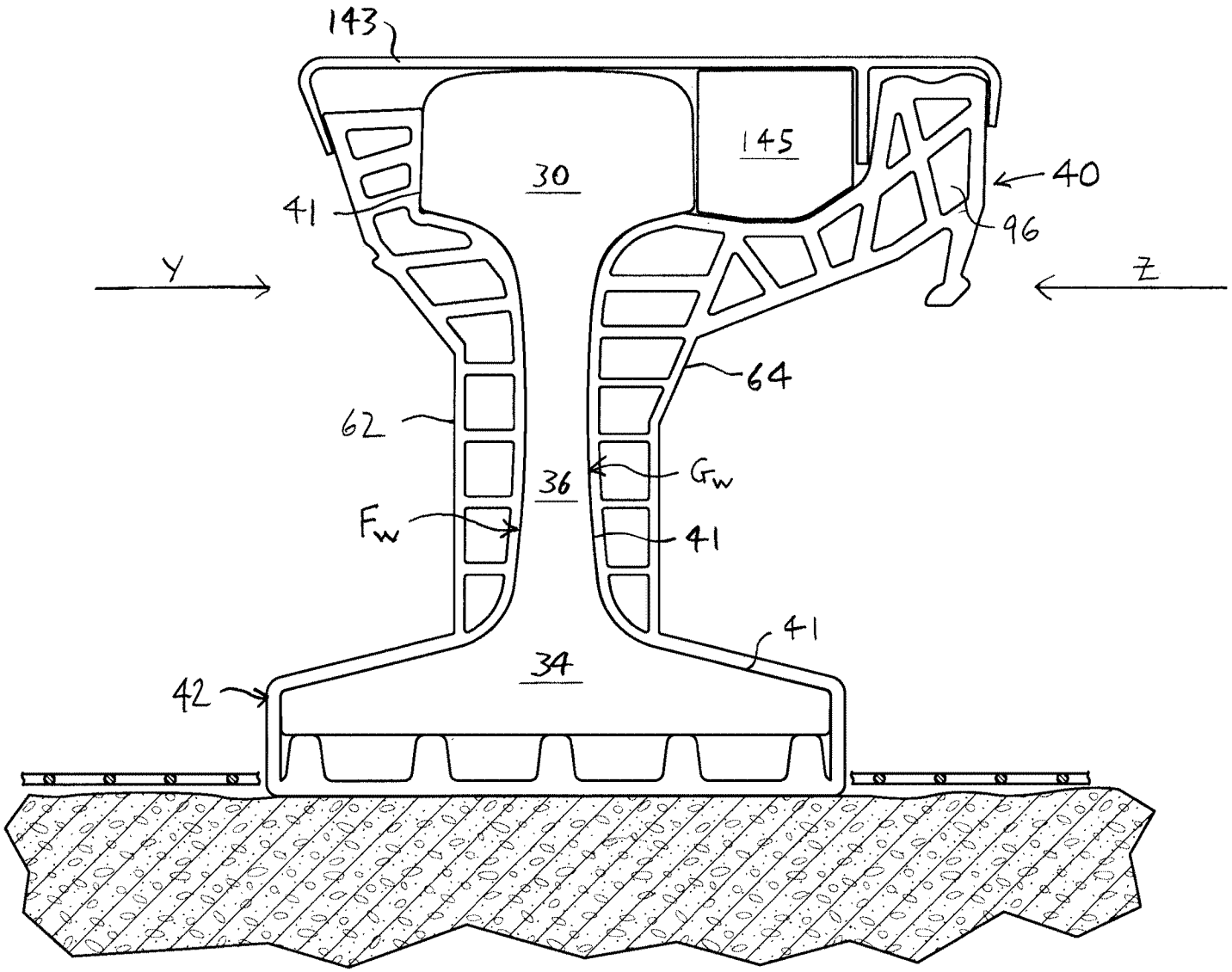
FIG. 2A is an end view of an embodiment of a rail boot of the invention, positioned on a rail and partly installed.

As will be described, the rail boot 40 is for encasing preselected engagement portions 41 of a rail 14 (FIG. 2A). In one embodiment, the rail boot 40 preferably includes a base segment 42, for encasing the rail foot 34. Preferably, the rail boot 40 also includes field and gauge side segments 44, 46 (FIG. 3A) respectively connected with the base segment 42, for encasing the field and gauge sides "$F_W$", "$G_W$" of the rail web 36 respectively. It is also preferred that the field side segment 44 is formed for additionally encasing a first preselected portion 48 of the field side "$F_H$" of the rail head 30. The gauge side segment 46 is also preferably formed for encasing a second preselected portion 50 of the gauge side "$G_H$" of the rail head 30, as will be described.

Figure 3A:
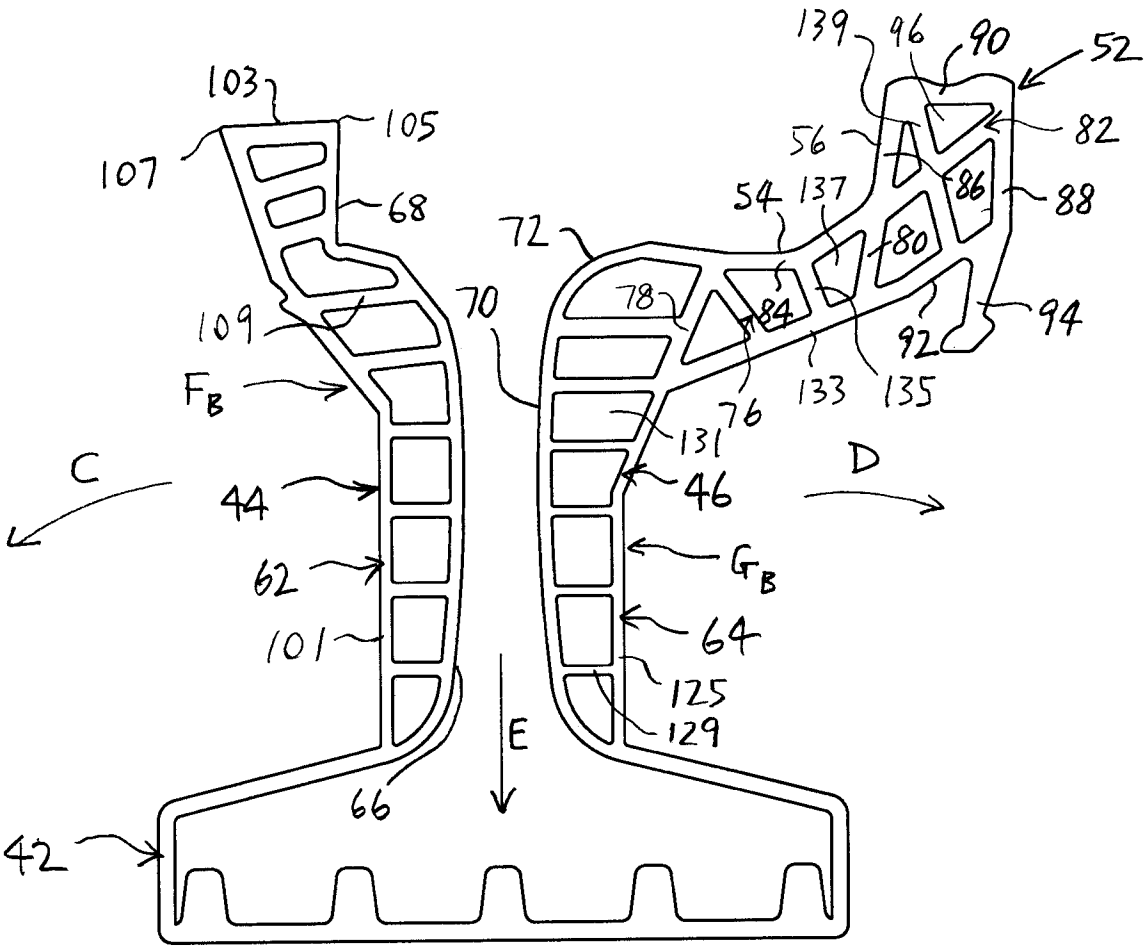
FIG. 3A is a cross-section of the rail boot of FIG. 2A.

Preferably, the rail boot 40 also includes an outer segment 52 (FIG. 3A). As will be described, the outer segment 52 preferably extends outwardly from the gauge side segment 46, away from the rail 14, and defines a bottom side 54 and an outer side 56 of a flangeway 58 in which the flanges "B" of the rail wheels "A" are receivable.

As will also be described, the field and gauge side segments 44, 46 and the outer segment 52 preferably are configured for resiliently resisting pressures exerted thereon.

The rail boot 40 preferably is made of any suitable resilient material, e.g., a thermoplastic elastomer. Accordingly, once fully installed, the rail boot 40 tends to resiliently resist the pressures to which the rail boot 40 is subjected.

As can be seen in FIG. 3A, the rail boot 40 preferably has a unibody construction, in which the segments thereof are integrated with each other, to form a single integral unit, homogeneous throughout. As will be described, the unibody construction has a number of advantages, including simplifying the installation of the rail boot 40, as compared to the rail boots of the prior art.

Figure 2B:
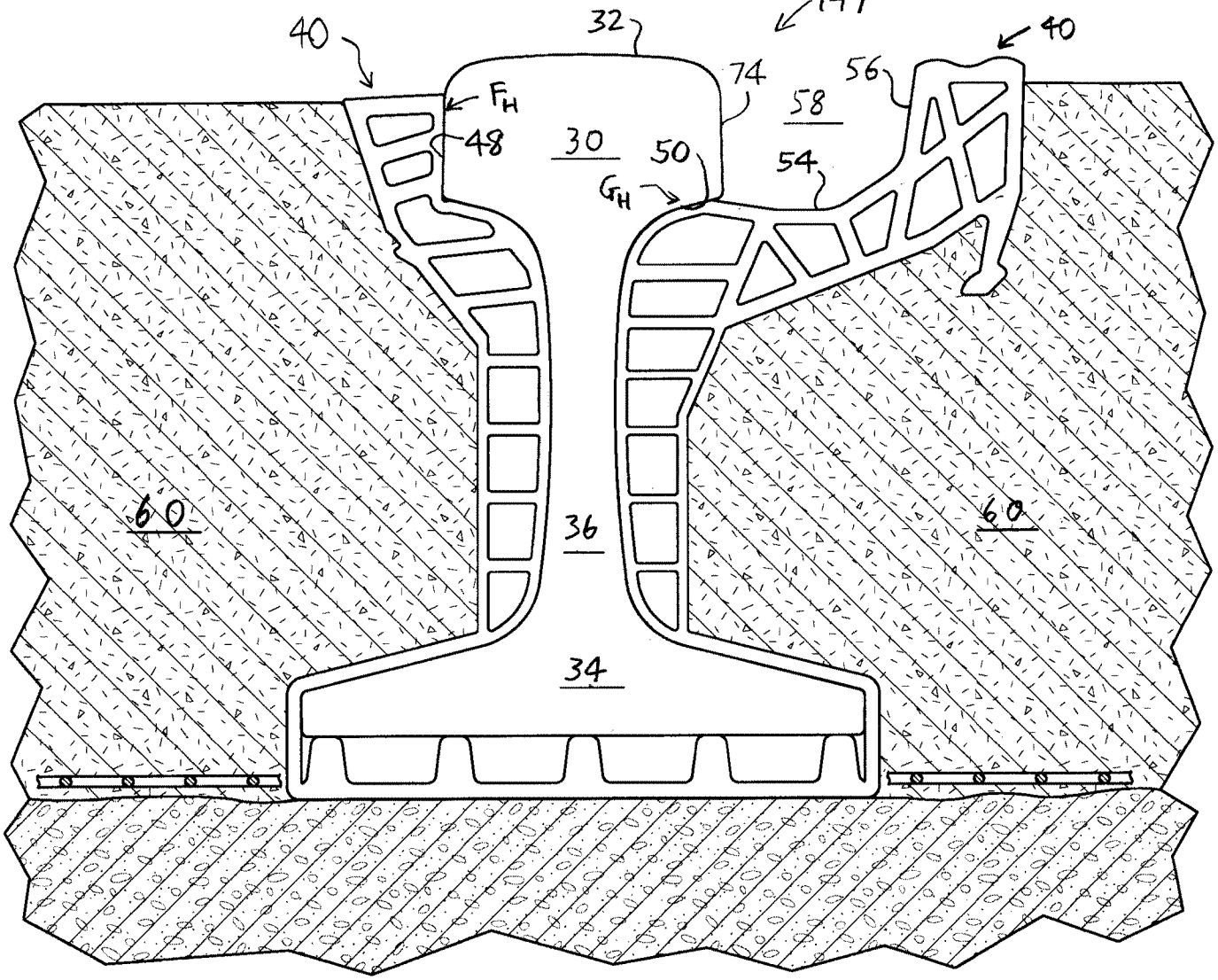
FIG. 2B is an end view of the rail boot of FIG. 2A, fully installed, with fill-engaging exterior surfaces of the rail boot.
Figure 2C:
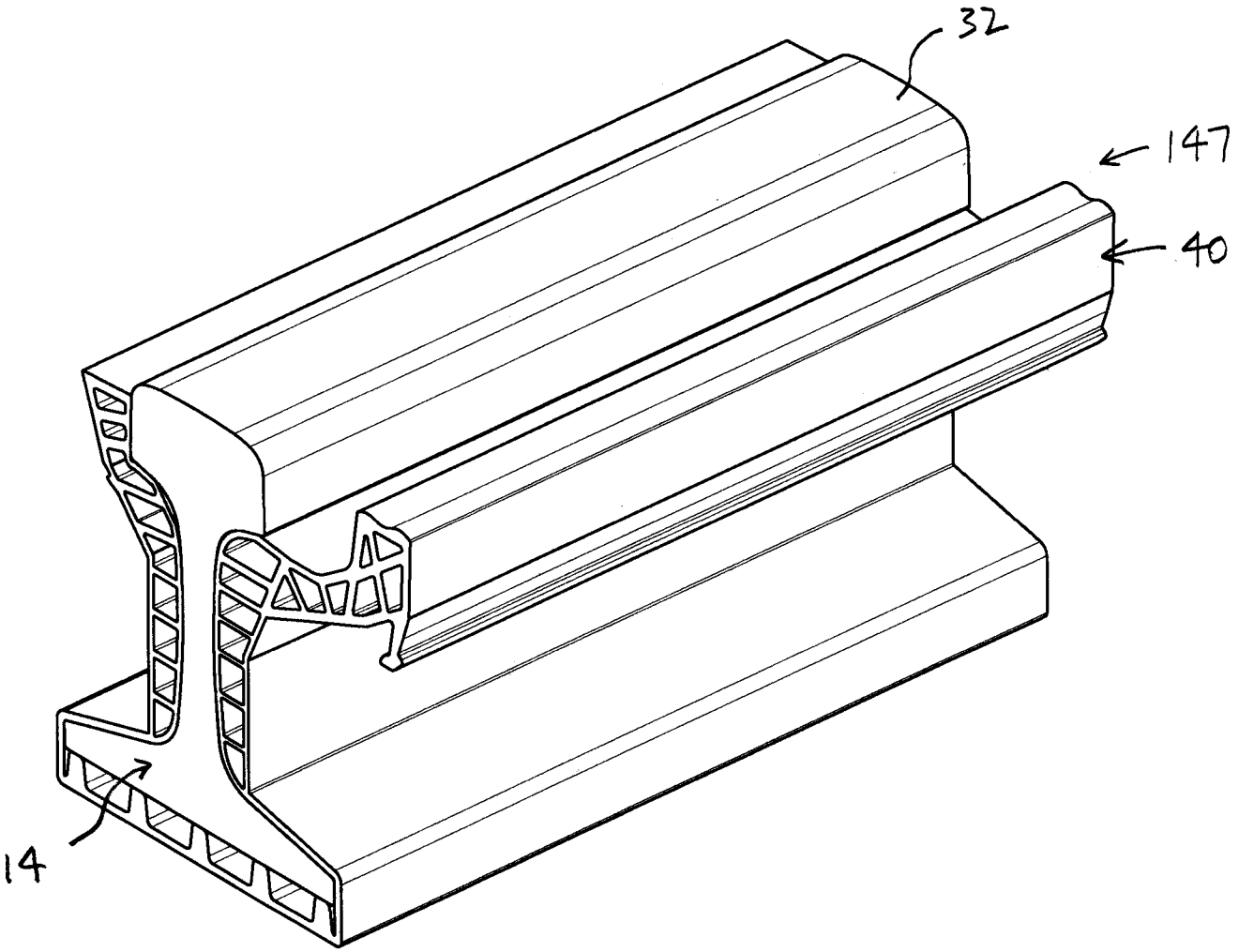
FIG. 2C is an upper isometric view of the rail boot and rail of FIG. 2A, drawn at a smaller scale.
Figure 2D:
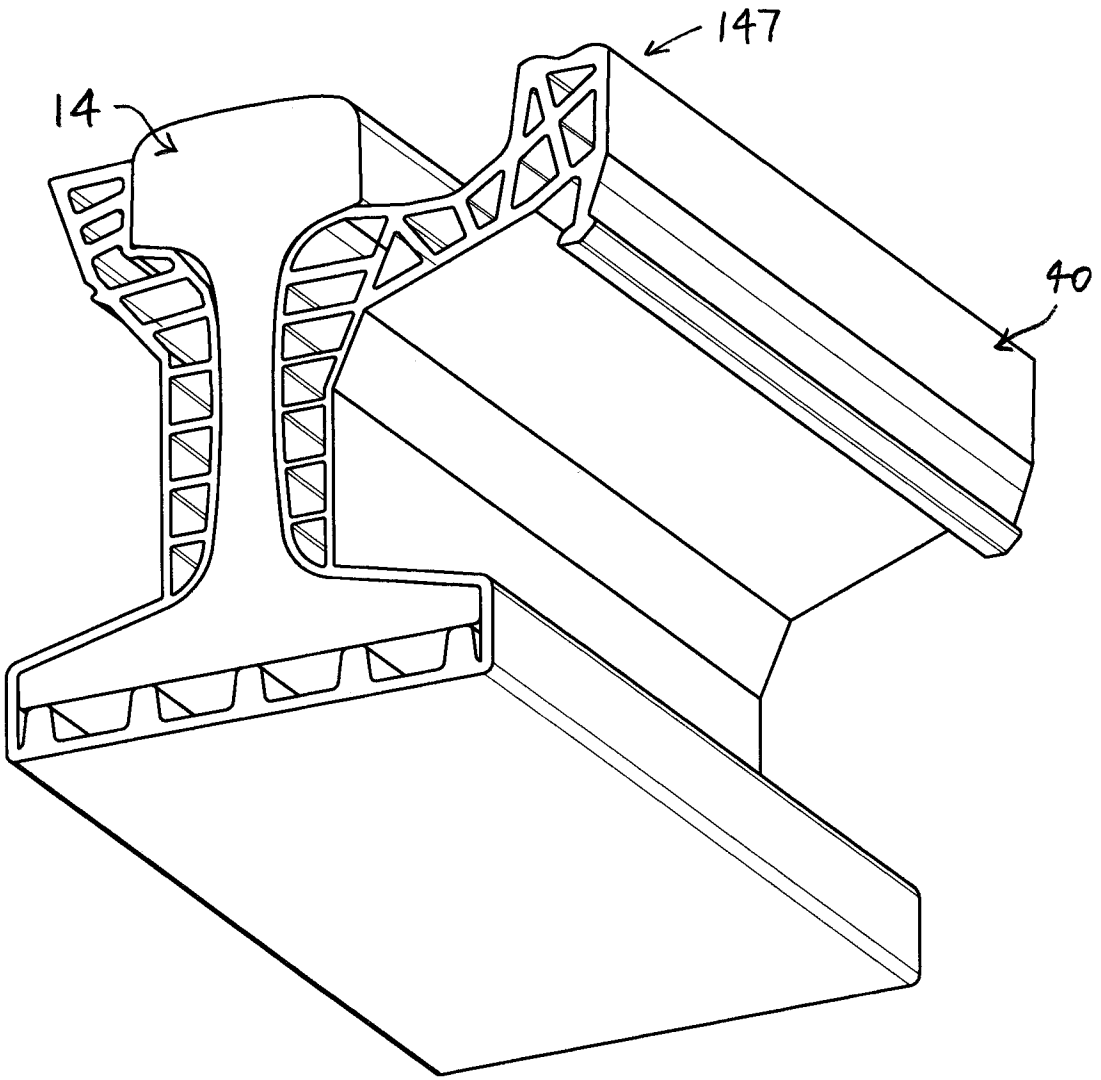
FIG. 2D is a lower isometric view of the rail boot and rail of FIG. 2A.

For convenience, the field and gauge sides of the rail boot 40 are generally identified by reference characters "$F_B$" and "$G_B$" respectively (FIG. 3A). As can be seen in FIG. 2B, in the last step in the installation process, fill material 60 is positioned around the rail boot 40. The fill material 60 is positioned against respective exterior surfaces 62, 64 of the field and gauge sides "$F_B$", "$G_B$" of the rail boot 40 (FIG. 3A). Those skilled in the art would appreciate that the fill material 60 may be any suitable material, or materials (e.g., installed in layers). As illustrated, the fill material 60 may be concrete, however, those skilled in the art would be aware of the different materials that may be used.

Figure 3B:
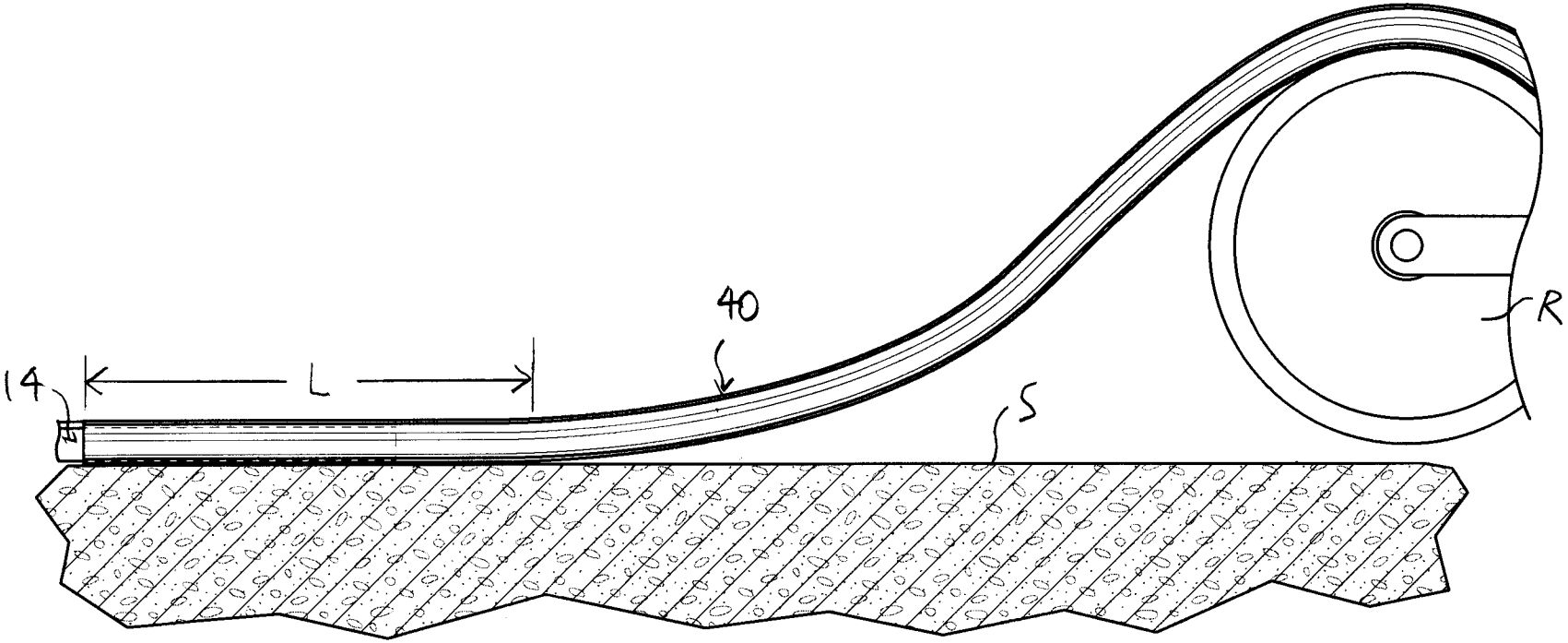
FIG. 3B is a side view of a rail and the rail boot of the invention during installation, drawn at a smaller scale.

In one embodiment, the invention include a method of installing the rail boot 40, generally illustrated in FIG. 3B. The rail boot 40 is provided at an installation site, at which the rail boot 40 is to be mounted on the rail 14 and the rail is to be secured. The rail boot 40 may be provided in any suitable overall length. As can be seen in FIG. 3B, the rail boot 40 may be delivered to the site on a reel "R" or other suitable device. In practice, the rail boot 40 may be delivered to the site in lengths up to approximately 600 to 700 feet (approximately 183 to 213 meters).

First, a predetermined length "L" of the rail boot 40 preferably is located upright on a ground surface "S" (FIG. 3B). At this point, the rail boot 40 is prepared to receive a preselected length of the rail 14 therein. The preselected length of the rail 14 may be any suitable length. Ideally, the rail 14 is as long as is practicable. However, those skilled in the art would appreciate that there are practical limits on the length of the rail 14 that may be positioned in the rail boot 40.

In practice, the length of the rail 14 that may be inserted may be up to approximately 120 feet (approximately 37 meters). It will be understood that the predetermined length of the rail boot 40 that is laid out on the ground surface "S" is at least sufficient to receive the preselected length of the rail 14 that is to be inserted therein. As a practical matter, and as illustrated in FIG. 3B, where the rail boot 40 is unrolled off the reel "R", the predetermined length of the rail boot 40 that is laid out on the ground surface "S" to receive the preselected length of the rail 14 preferably is longer than the preselected length of the rail 14 to be inserted therein.

In FIG. 3B, a part of the rail 14 is shown extending outwardly from the rail boot 40. It will be understood that the rail is shown in this way for clarity of illustration only, so that the rail can be clearly seen in FIG. 3B.

Those skilled in the art would appreciate that the rail 14, once encased by the rail boot 40 mounted thereon, is intended ultimately to be installed at a predetermined location on the ground surface "S", aligned with other rails that are already installed, or that will be installed. Accordingly, the predetermined length of the rail boot 40 preferably is located on the ground surface "S" at or near the predetermined location, generally parallel with the predetermined location of the rail 14.

The preselected length of the rail 14 is then inserted into the rail boot 40, for encasing the preselected engagement portions 41 of the rail 14 in the rail boot 40.

The rail boot 40, prior to insertion of the rail 14 therein, can be seen in FIG. 3A. Those skilled in the art would appreciate that the rail boot 40 may be manipulated to mount the rail boot 40 onto the rail 14. For example, the rail boot 40 may be opened up slightly by pulling the field side 44 and the gauge side 46 of the rail boot 40 in the directions generally indicated by arrows "C" and "D" respectively in FIG. 3A. The rail 14 (not shown in FIG. 3A) may then be lowered into the opened rail boot 40, in the direction indicated by arrow "E" in FIG. 3A, to locate the rail foot 34 in the base segment 42. Once the rail foot 34 is located in the base segment 42, some manipulation of the side segments 44, 46 may be required, in order to ensure that the side segment 44 is adhering to the field side of the web "$F_W$" and the first preselected portion 48 of the field side of the head "$F_H$", and to ensure that the side segment 46 is adhering to the gauge side of the web "$G_W$" and the second preselected portion 50 of the gauge side of the head "$G_H$".

At this point in the process, although the preselected length of the rail 14 is inserted into the rail boot 40, and the preselected engagement portions 41 of the rail 14 are encased by the rail boot 40, in practice, the rail 14 and the rail boot 40 thereon may not be in the rail's predetermined location. As noted above, the rail 14, with its preselected engagement portions 41 covered by the rail boot 40, preferably is located, at this point in the installation process, proximal to the rail's predetermined location. Accordingly, as a practical matter, minor adjustments in the position of the rail 14 may be made in order to position the rail 14 and the rail boot 40 in the predetermined location thereof. Once the rail 14 (with the rail boot 40 mounted thereon) is in the predetermined location thereof, the rail 14 is then secured in the predetermined location, by any suitable means.

Preferably, once the rail 14 (with the rail boot 40 mounted thereon) is in the predetermined location thereof, the fill material 60 is positioned against the exterior surfaces 62, 64 on the field and gauge sides "$F_B$", "$G_B$" of the rail boot 40, to support the rail 14 in the predetermined location thereof. As illustrated in FIG. 2B, the fill material 60 may be concrete.

It is preferred that the rail boot 40 is made of any suitable elastomeric material. The rail boot 40 may be formed using any suitable method. In one embodiment, for example, the rail boot 40 preferably is extruded. Preferably, the rail boot 40 is positioned on the reel "R" as the rail boot 40 is extruded, to expedite the rail boot's installation.

As noted above, in one embodiment, the rail boot 40 preferably is provided in relatively long lengths, e.g., approximately 600 feet, at the site. It will be understood that, because the rail boot 40 is delivered to the site on the reel "R", a relatively long continuous length of the rail boot 40 may be installed on abutting lengths of the rail 14 at the site. Those skilled in the art would appreciate that this means, in practice, that relatively few joints are required to provide insulation between abutting lengths of the rail boot 40. Accordingly, as compared to the prior art rail boot (described above), the rail boot 40 when installed substantially decreases the risk of stray currents.

From the foregoing, it can be seen that the rail boot 40 of the invention has the advantage that it is relatively easy to install because of its unitary construction. Also, because of the rail boot's unitary construction, the risk of errors in installation of the prior art boot is minimized.

In addition, because of the unitary construction of the rail boot 40, there is no path for stray currents that might correspond to the path "P" defined in the prior art boot 10. The rail boot 40 does not have an opening that would allow water to collect therein, and in this way also, the rail boot 40 provides better performance than the prior art boot 10.

As can be seen, e.g., in FIG. 3A, the field side segment 44 is connected with the base segment 42. The field side segment 44 preferably includes a first rail interior wall 66 for covering or encasing the field side of the rail web "$F_W$", and a first rail head element 68 for covering or encasing the first preselected portion 48 of the field side of the rail head "$F_H$" (FIG. 3A).

Preferably, the gauge side segment 46 is also connected with the base element 42. The gauge side segment 46 preferably includes a second rail interior wall 70 for covering or encasing the gauge side of the rail web "$G_W$". As can be seen in FIG. 3A, it is also preferred that the gauge side segment 46 includes a second rail head element 72 for covering or encasing the second preselected portion 50 of the gauge side of the rail head "$G_H$".

Figure 1C:
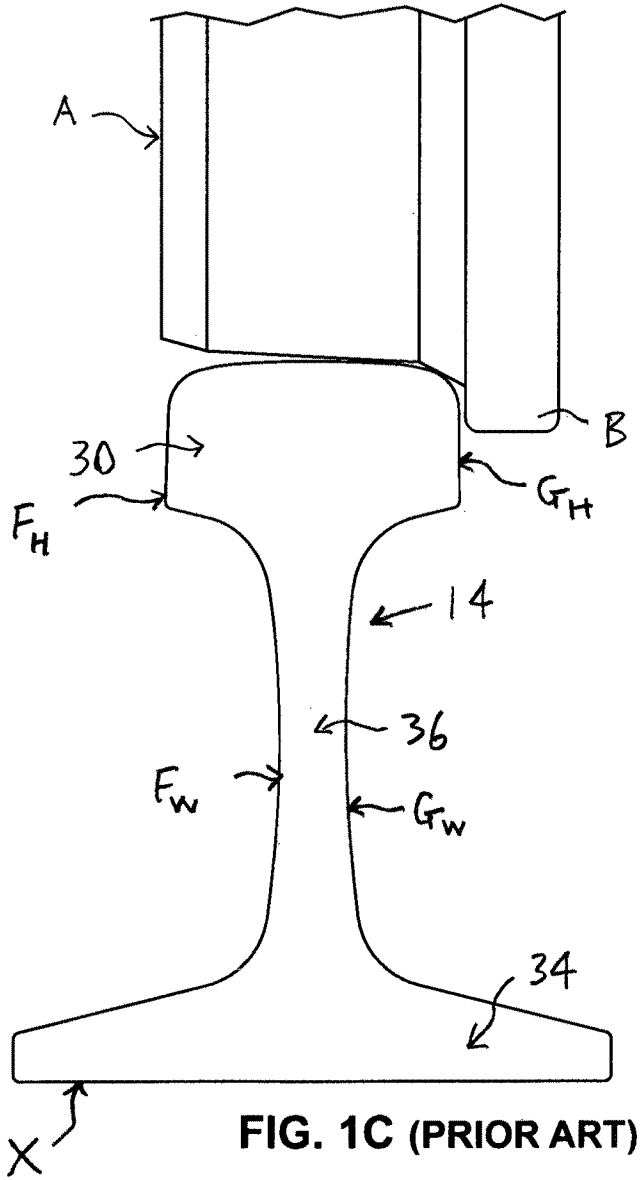
FIG. 1C (PRIOR ART)
FIG. 1C (previously described) is an end view of the rail.

It will be understood that the preselected engagement portions 41 of the rail 14 that are engaged and encased by the rail boot 40 include exterior surfaces "X" of the rail foot 34 (FIG. 1C), the exterior field and gauge sides "$F_W$", "$G_W$" of the rail web 36 (FIG. 1C), and the first and second preselected portions 48, 50 of the rail head 30 (FIG. 2B). It will also be understood that the rail boot 40 preferably is shaped and sized so that it fits tightly onto the preselected engagement portions 41 of the rail 14.

The second rail head element 72 preferably also defines an exposed portion 74 of the gauge side of the rail head "$G_H$" (FIG. 2B).

Figure 2E:
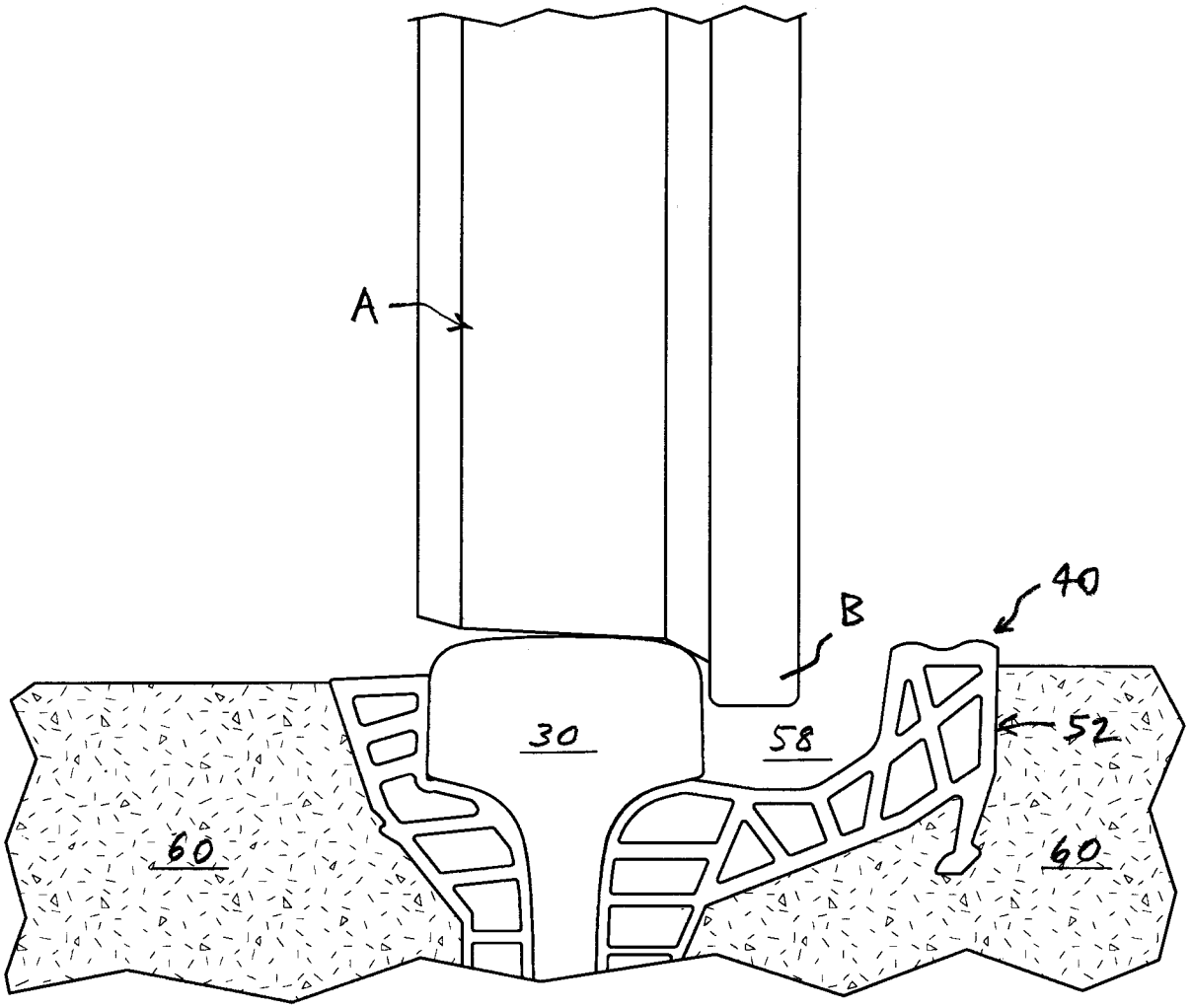
FIG. 2E is an end view of the rail boot and the rail of FIG. 2B, with the rail supporting a rail wheel thereon.

As can be seen in FIGS. 2A, 2B, and 3A, it is preferred that the outer segment 52 defines the flangeway 58 in relation to the exposed portion 74. Those skilled in the art would appreciate that the flangeway 58 is sized and shaped to accommodate the flanges "B" of rail wheels "A" as the rail wheels travel over the top surface 32 of the rail 14 (FIG. 2E). Preferably, the outer segment 52 includes an arm element 76 that extends between inner and outer ends 78, 80. The arm element 76 preferably is connected at the inner end 78 thereof to the gauge side segment 46 (FIG. 3A).

Preferably, the outer segment 52 also includes a wall element 82 that is connected to the outer end 80 of the arm element 76. As can be seen in FIG. 3A, the arm element 76 and the wall element 82 preferably include respective arm and wall inner parts 84, 86. The arm inner part 84 defines the bottom side 54 of the flangeway 58, and the wall inner part 86 defines the outer side 56 of the flangeway 58. It can be seen in FIG. 2A that the arm and wall inner parts 84, 86 are formed to partially define the flangeway 58 in relation to the exposed portion 74 of the gauge side of the rail head "$G_H$".

In one embodiment, the wall element 82 preferably includes a wall exterior part 88 that is located opposite to the wall inner part 86, and spaced apart from the wall inner part 86. The wall element 82 preferably also includes an upper side part 90, extending between the wall inner part 86 and the wall exterior part 88. In one embodiment, the wall element 82 preferably also includes a lower side part 92, extending from the outer end 80 of the arm element 76 toward the wall exterior part 88, and an anchor 94, projecting from the lower side part 92.

It will be understood that the wall exterior part 88 and the lower side part 92 are included in the exterior surface 64.

As can be seen in FIG. 2A, a wall element cavity 96 is defined in the wall element 82 by the wall inner part 86, the wall exterior part 88, and the lower side part 92.

In one embodiment, the field side segment 44 preferably includes the first interior wall 66, formed to encase the field side of the rail web "$F_W$" and the first preselected portion 48 of the field side of the rail head "$F_H$". The field side segment 44 preferably also includes a first exterior wall 101, located outwardly from the first interior wall 66 relative to the field side of the web "$F_W$" and the field side of the head "$F_H$" of the rail 14. It is also preferred that the field side segment 44 includes a field side upper part 103, extending between the first interior and first exterior walls 66, 101 at upper ends 105, 107 thereof.

As can also be seen in FIG. 3A, the field side segment 44 preferably also includes a number of first side ribs 109 located between the first interior and first exterior walls 66, 101, for resiliently resisting pressure exerted against the first interior and first exterior walls 66, 101.

It can be seen in FIG. 3A that the first interior and first exterior walls 66, 101 and the field side upper part 103 define a field side segment cavity 111, in which the first side ribs 109 are located. It will be understood that the first side ribs 109 preferably are formed of the same elastomeric material that the first interior and exterior walls 66, 101 are made of. Accordingly, when pressure is exerted against the first interior wall 66 or the first exterior wall 101, the ribs 109 resiliently resist such pressure, to substantially the same extent that the walls 66, 101 resiliently resist the pressure.

In one embodiment, the gauge side segment 46 preferably includes the second interior wall 70, formed to encase the gauge side of the rail web "$G_W$" and the second preselected portion 50 of the gauge side of the rail head "$G_H$". The gauge side segment 46 preferably also includes a second exterior wall 125, located outwardly from the second interior wall 70 relative to the gauge side of the web "$G_W$" and the gauge side of the head "$G_H$" of the rail 14.

As can also be seen in FIG. 3A, the gauge side segment 46 preferably also includes a number of second side ribs 129 located between the second interior and second exterior walls 70, 125, for resiliently resisting pressure exerted against the second interior and second exterior walls 70, 125.

It can also be seen in FIG. 3A that the second interior and second exterior walls 70, 125 define a gauge side segment cavity 131, in which the second side ribs 129 are located. It will be understood that the second side ribs 129 preferably are formed of the same elastomeric material that the second interior and exterior walls 70, 125 are made of. Accordingly, when pressure is exerted against the second interior wall 70 or the second exterior wall 125, the ribs 129 resiliently resist such pressure, to substantially the same extent that the walls 70, 125 resiliently resist the pressure.

In one embodiment, the arm element 76 of the outer segment 52 preferably includes an arm exterior part 133, positioned opposite to the arm inner part 84. It will be understood that the arm exterior part 133 is included in the exterior surface 64 of the gauge side of the rail boot 40. It is also preferred that the arm element 76 includes a number of ribs 135. The arm exterior part 133 and the arm inner part 84 define an arm cavity 137 therebetween, in which the ribs 135 are located, for resiliently resisting pressure exerted against one or both of the arm exterior part 133 and the arm inner part 84.

It will be understood that the ribs 135 preferably are formed of the same elastomeric material that the arm exterior part and the arm inner part 133, 84 are made of. Accordingly, when pressure is exerted against the arm exterior part and the arm inner part 133, 84, the ribs 135 resiliently resist such pressure, to substantially the same extent that the arm exterior part and the arm inner part 133, 84 resiliently resist the pressure.

Preferably, the wall element 82 of the outer segment 52 includes a number of wall ribs 139 located between the wall exterior part 88, the wall inner part 86, the upper side part 90, and the lower side part 92. The ribs 139 resiliently resist pressure exerted against one or more of the wall exterior part 88, the wall inner part 86, the upper side part 90, and the lower side part 92. The ribs 139 are formed of the same elastomeric material that the wall exterior part 88, the wall inner part 86, the upper side part 90, and the lower side part 92 are made of. Accordingly, when pressure is exerted against one or more of the wall exterior part 88, the wall inner part 86, the upper side part 90, and the lower side part 92, the ribs 139 resiliently resist such pressure, to substantially the same extent that the wall exterior part 88, the wall inner part 86, the upper side part 90, and the lower side part 92 resiliently resist the pressure.

It will be understood that the wall exterior part 88, and the lower side part 92 are included in the exterior surface 64 of the gauge side of the rail boot 40.

In one embodiment, the invention additionally includes a system 147 that includes the rail 14 and the rail boot 40 mounted to the rail 14, encasing the preselected engagement portions 41 of the rail 14 (FIG. 2B).

As described above, in FIG. 2A, the system 147 is shown in the predetermined location at the site, prior to the fill material 60 being positioned against the exterior surfaces 62, 64 of the rail boot 40.

In one embodiment, the method of the invention includes an additional step of, after the system 147 is located in the predetermined location, but before the fill material 60 is introduced, attaching one or more support clips 143 to the field side segment 44 and to the wall element 82 of the outer segment 52, for supporting the wall element 82, when the fill material 60 is engaged with the exterior surface 64 of the gauge side of the rail boot 40 (FIG. 2A). One or more spacers 145 may be positioned in the flangeway 58 when the fill material 60 is engaged with the exterior surface 64 (FIG. 2A).

Those skilled in the art would appreciate that, when the fill material 60 is positioned against the exterior surfaces 62, 64 of the field and gauge sides of the rail boot 40, the fill 60 pushes inwardly, in the directions generally indicated by arrows "Y" and "Z" respectively in FIG. 2A. The clips 143 are intended to hold the rail boot 40 in position on the rail 14, i.e., to withstand the pressure exerted by the fill material 60 when it is introduced. For the same reason, the spacer 145 is intended to hold the shape of the flangeway 58. It will be understood that a number of the clips 143 may be positioned on the rail boot 40 along the length of the rail 14 on which the rail boot 40 is mounted, and a number of spacers 145 may also be positioned along the rail 14. It will also be understood that the clips 143 and the spacers 145 are removed once the fill material 60 has cured.

As noted above, the rail boot 40 includes cavities inside it in which ribs are located to strengthen the structure. The cavities tend to absorb energy. Due to its integral construction, the rail boot 40 has a number of advantages. First, because the rail boot 40 has a unitary construction, and also because the boot is made of elastomeric material that has a high level of electrical resistivity, return current is substantially prevented from finding its way to adjacent utilities. As compared to the prior art, the risk of corrosion is substantially reduced, thereby reducing maintenance costs.

Second, as noted above, the unitary construction of the rail boot 40 minimizes the risk of improper installation. The unitary construction also limits the opportunities available for ingress of water into the rail boot 40.

As noted above, the rail boot 40 field and gauge side segments 44, 46 fit closely to the rail 14, providing maximum surface contact of the interior walls 66, 121 of the field and gauge side segments 44, 46 with the rail 14. Vibrations imported to the rail 14 by rail wheels passing along the top surface 32 are dampened by the rail boot 40, due to the close fit of the boot onto the rail, the energy absorbing cavities defined therein, and the elasticity of the material of the boot 40.

Those skilled in the art would appreciate that, when rail vehicles (not shown) move along the rail 14, and the rail wheels "A" thereof engage the top surface 32 of the rail 14, the rail 14 is subjected to forces that urge the rail 14 to move. The elasticity of the boot 40 helps to limit and control the amount of rail movement. Those skilled in the art would also appreciate that controlling movement of the rail inside the fill (e.g., concrete) placed on each side of the boot limits the risk of transfer of destructive forces to the fill, thereby reducing the extent of maintenance required.

In addition, as noted above, the rail boot 40 preferably is provided in relatively long lengths at the site, to minimize joints required with abutting rail boots, thereby also minimizing the potential exposure to stray currents.

It will be appreciated by those skilled in the art that the invention can take many forms, and that such forms are within the scope of the invention as claimed. The scope of the claims should not be limited by the preferred embodiments set forth in the examples, but should be given the broadest interpretation consistent with the description as a whole.

We claim:

1. A rail boot (40) for encasing preselected engagement portions (41) of a rail (14) having a rail head (30) with a top surface (32) and a rail foot (34) connected by a rail web (36), each of the rail head and the rail web having a respective field side ("$F_H$", "$F_W$") and an opposed gauge side ("$G_H$", "$G_W$"), the rail being formed to support rail wheels engaged with the top surface and having respective flanges extending below the top surface on the gauge side ("$G_W$") of the rail head, the rail boot comprising:

a base segment (42), for encasing the rail foot (34);

field and gauge side segments (44, 46) respectively integrated with the base segment (42), for encasing the field and gauge sides ("$F_W$", "$G_W$") of the rail web (36) respectively, the field side segment (44) being formed for additionally encasing a first preselected portion (48) of the field side ("$F_H$") of the rail head (30) and the gauge side segment being formed for encasing a second preselected portion (50) of the gauge side ("$G_H$") Of the rail head (30); and an outer segment (52) integrated with and extending outwardly from the gauge side segment (46) and defining a bottom side (54) and an outer side (56) of a flangeway (58) in which the flanges are receivable, wherein the rail boot has a unitary construction.

2. A rail boot according to claim 1 in which the field and gauge side segments and the outer segment are configured for resiliently resisting pressures exerted thereon.

3. A rail boot for covering preselected engagement portions of a rail having a rail head and a rail foot connected by a rail web, each of the rail head and the rail web having a respective field side and an opposed gauge side, the rail boot comprising:

a base segment (42) formed for covering the rail foot;

a field side segment (44) integrated with the base segment (42), the field side segment comprising:

a first rail interior wall (66) for covering the field side ("$F_W$") of the rail web;

a first rail head element (68) for covering a first preselected portion (48) of the field side of the rail head;

a gauge side segment (46) integrated with the base segment (42), the gauge side segment comprising:

a second rail interior wall (70) for encasing the gauge side ("$G_W$") of the rail web;

a second rail head element (72) for encasing a second preselected portion (50) of the gauge side of the rail head ("$G_H$"), the second rail head element defining an exposed portion (74) of the gauge side ("$G_H$") of the rail head;

an outer segment (52) for defining a flangeway (58) in relation to the exposed portion (74), the outer segment being integrated with the gauge side segment, the outer segment comprising:

an arm element (76) extending between inner and outer ends (78, 80) thereof, the arm element being connected at the inner end thereof to the gauge side segment (46);

a wall element (82) connected to the outer end (80) of the arm element (76); and the arm element (76) and the wall element (82) comprising respective arm and wall inner parts (84, 86) formed to partially define the flangeway (58) in relation to the exposed portion (74) of the gauge side of the rail head ("$G_H$"), wherein the rail boot has a unitary construction.

4. A rail boot according to claim 3 in which the wall element (82) comprises:

a wall exterior part (88) located opposite to the wall inner part (86), and spaced apart from the wall inner part; and an upper side part (90), extending between the wall inner part (86) and the wall exterior part (88).

5. A rail boot according to claim 4 in which the wall element additionally comprises:

a lower side part (92), extending from the outer end (80) of the arm element (76) toward the wall exterior part (88); and an anchor (94), projecting from the lower side part (92).

6. A rail boot according to claim 3 in which the first side segment (44) comprises:

a first interior wall (66), formed to adhere to the field side of the rail web ("$F_W$") and the first preselected portion (48) of the field side of the rail head ("$F_H$");

a first exterior wall (101), located outwardly from the first interior wall (66) relative to the field side rail; and a plurality of first side ribs (109) located between the first interior and first exterior walls (66, 101), for resiliently resisting pressure exerted against the first interior and first exterior walls (66, 101).

7. A rail boot according to claim 3 in which the gauge side segment comprises:

a second interior wall (70), formed to adhere encase the gauge side of the rail web ("$G_W$") and the second preselected portion (50) of the gauge side of the rail head ("$G_H$");

a second exterior wall (125), located outwardly from the second interior wall (70) relative to the rail; and a plurality of second side ribs (129) located between the second interior and second exterior walls (70, 125), for resiliently resisting pressure exerted against the second interior and second exterior walls (70, 125).

8. A rail boot according to claim 3 in which the arm element of the outer segment comprises:

an arm exterior part (133), positioned opposite to the arm inner part (84); and a plurality of ribs (135) located between the arm exterior part (133) and the arm inner part (84), for resiliently resisting pressure exerted against one or more of the arm exterior part (133) and the arm inner part (84).

9. A rail boot according to claim 5 in which the wall element of the outer segment comprises:

a plurality of wall ribs (139) located between the wall exterior part (88), the wall inner part (86), the upper side part (90), and the lower side part (92), for resiliently resisting pressure exerted against one or more of the wall exterior part, the wall inner part, the upper side part, and the lower side part.

10. A system (147) comprising:

a rail (14) having a rail head and a rail foot connected by a rail web, each of the rail head and the rail web having a respective field side and an opposed gauge side, the rail being formed to support rail wheels engaged with a top surface of the rail head and having respective flanges extending below the top surface on the gauge side of the rail head;

a rail boot (40) for encasing preselected engagement portions (41) of the rail comprising:

a base segment, for encasing the rail foot;

field and gauge side segments respectively integrated with the base segment, for encasing the field and gauge sides of the rail web respectively, the field side segment being formed for encasing a first preselected portion of the field side of the rail head and the gauge side segment being formed for encasing a second preselected portion of the gauge side of the rail head; and an outer segment integrated with and extending outwardly from the gauge side segment and defining a bottom side and an outer side of a flangeway in which the flanges are receivable, wherein the rail boot has a unitary construction.

11. A method of installing a rail boot for covering preselected engagement portions of a rail having a rail head and a rail foot connected by a rail web, each of the rail head and the rail web having a respective field side and an opposed gauge side, the rail being formed to support rail wheels engaged with a top surface of the rail head and having respective flanges extending below the top surface on the gauge side of the rail head, the method comprising:

(a) providing a rail boot, the rail boot comprising:

(i) a base segment, for encasing the rail foot;

(ii) field and gauge side segments respectively integrated with the base segment, for encasing the field and gauge sides of the rail web respectively, the field side segment being formed for encasing a first preselected portion of the field side of the rail head and the gauge side segment being formed for encasing a second preselected portion of the gauge side of the rail head;

(iii) an outer segment integrated with and extending outwardly from the gauge side segment and defining a bottom side and an outer side of a flangeway in which the flanges are receivable, wherein the rail boot has a unitary construction:

(b) locating a predetermined length of the rail boot upright on a ground surface;

(c) inserting a preselected length of the rail in the rail boot, for encasing the preselected engagement portions of the rail;

(d) locating the rail, with the rail boot thereon, in a predetermined location thereof; and (e) positioning the fill material against exterior surfaces on the field and gauge sides of the rail boot, to support the rail in the predetermined location thereof.

12. A method according to claim 11 in which:

the outer segment comprises:

an arm element extending between inner and outer ends thereof, the arm element being connected at the inner end thereof to the gauge side segment;

a wall element connected to the outer end of the arm element;

the arm element and the wall element comprising the bottom side and the outer side of the flangeway respectively; and the method additionally comprising:

immediately following step (d), attaching at least one support clip (143) to the first side segment and to the wall element of the outer segment, for supporting the wall element to maintain the flangeway when the fill material is engaged with the gauge side segment and the outer segment.

* * * * *